US005348492A

United States Patent [19]

Sonnet

[11] Patent Number: 5,348,492

[45] Date of Patent: Sep. 20, 1994

[54] BRACKET AND CONNECTOR FOR A CABLE INSERTED INTO A PIPE FOR ENABLING A MEASUREMENT IN THE CABLE

[75] Inventor: Alain Sonnet, Rueil Malmaison, France

[73] Assignee: Institut Francais du Petrole, Rueil Malmaison, France

[21] Appl. No.: 23,563

[22] Filed: Feb. 26, 1993

[30] Foreign Application Priority Data

Feb. 27, 1992 [FR] France ..... 92 02272

[51] Int. Cl.[5] ..... E21B 47/12

[52] U.S. Cl. ..... 439/194; 166/65.1

[58] Field of Search ..... 439/190–195; 166/65.1, 66; 175/104, 105

[56] References Cited

U.S. PATENT DOCUMENTS

| | | | |
|---|---|---|---|
| 2,748,358 | 5/1956 | Johnston | 166/65.1 |
| 4,133,992 | 1/1979 | Walker et al. | 439/278 |
| 4,181,184 | 1/1980 | Scherbatskoy | 175/65 |
| 4,220,381 | 9/1980 | van der Graff | 439/194 |
| 4,438,996 | 3/1984 | Zehren | 439/374 |
| 4,557,538 | 12/1985 | Chevalier | 439/194 |
| 4,589,492 | 5/1986 | Greiner et al. | 166/65.1 |
| 4,806,115 | 2/1989 | Chevalier | 439/194 |
| 5,219,298 | 6/1993 | Morin et al. | 439/192 |

FOREIGN PATENT DOCUMENTS

| | | |
|---|---|---|
| 0077275 | 10/1982 | European Pat. Off. . |
| 0099805 | 7/1983 | European Pat. Off. . |
| 0296788 | 6/1988 | European Pat. Off. . |
| 0391809 | 4/1990 | European Pat. Off. . |
| 2422025 | 4/1979 | France . |
| 2522059 | 3/1981 | France . |
| WO91/08373 | 6/1991 | PCT Int'l Appl. . |
| 1530647 | 11/1978 | United Kingdom . |

*Primary Examiner*—Neil Abrams

*Attorney, Agent, or Firm*—Antonelli, Terry, Stout & Kraus

[57] ABSTRACT

A bracket for a cable internal to a lower part of a tubular pipe. The bracket includes a head integral with an upper end of the cable and a body integrated in the pipe. The head includes an electrical contact connected to an electric cable conductor, with the contact electrically cooperating with an electric connection integral with the body of the bracket. The electric connection is connected through an electric link including a cable pipe element or cable running externally of the pipe. A measuring or servicing assembly to be carried out by lengthening or shortening the pipe by using either cabled pipe elements or simple cables and by controlling the length of the cable by a surface winch while maintaining an electrical link with a measuring and/or servicing assembly inserted into the tubular pipe.

9 Claims, 3 Drawing Sheets

16
1
15
4
17
13
2
14
5
3
6
7
8

BRACKET AND CONNECTOR FOR A CABLE INSERTED INTO A PIPE FOR ENABLING A MEASUREMENT IN THE CABLE

FIELD OF THE INVENTION

The invention relates to a bracket for a cable integrated in a tubular pipe. The cable is located inside a lower part of the tubular pipe, which is lowered in a well. The cable comprises at least one electric conductor intended to connect electrically the bracket to a measuring and/or servicing system located close to the lower end of the tubular string. The bracket is adapted to electrically connect the cable to the surface without requiring a cable located inside the upper part of the pipe, thus allowing ease of operation on the upper part to lengthen or to shorten this pipe and thereby to move the measuring assembly inside the well while maintaining the electric link. Moreover, the bracket may be adapted to allow the measuring system to be taken up at the end of the cable, then to be set again in the pipe, the system being then again electrically connected to the surface without any other intervention.

BACKGROUND OF THE INVENTION

Patent applications FR-91,09,915 and FR-91,09,916 propose the use of a cable internal to pipes and of an intermediate bracket supporting the upper end of this cable. However, there is no cable head co-operating electrically with a connection means integral with the body of the bracket, allowing notably electrical connection and disconnection.

SUMMARY OF THE INVENTION

The present invention describes a cable bracket adapted to be integrated in a tubular pipe, dividing the latter into two parts, a lower and an upper part. The cable is internal to the lower part of said pipe and comprises at least one electric conductor. The bracket comprises a body assembled between said two parts of the pipe and a cable head to which one end of the cable is fastened.

The body comprises a stop ring limiting in one direction the displacement of said head.

The head comprises at least one electric contact connected to the cable conductor. The contact co-operates electrically with a connection means when said head co-operates with the stop ring, the means being integral with the body.

The cable may comprise at least one device immovably fastened to its other end and the bracket may be adapted to allow inner passage of the device.

The connection means of the body may be adapted to connect electrically said contact of the head with a continuous electric link along the upper part of the pipe consisting of a string of electrically cabled stems.

The connection means of the body may connect electrically the contact to the end of a cable located outside the body of the bracket.

The device fastened to the end of the cable may comprise at least one of a measuring and/or servicing assembly or a connector adapted to connect onto a measuring and/or servicing assembly.

The cable head may comprise a fishing device adapted to be hung onto a tool lowered into the upper part of the pipe.

The invention further relates to a system for carrying out measurements and/or servicing operations in a well, with the system including an electric transmission cable internal to a lower part of a tubular pipe and comprising at least one a measuring and/or servicing assembly or a connector linking the cable to a measuring and/or servicing assembly. A continuous electric link may be provided between the bracket and the surface, which link may be achieved either through a cabled pipe element constituting the upper part of the tubular pipe, or through a cable located outside the pipe.

The invention describes a method for carrying out the measurings and/or servicings by the system of the present invention, with the method comprising displacing the measuring end or servicing assembly by lengthening or shortening the pipe, by using either cable pipe elements or simply cables, and by controlling, in this case, the length of the cable located in an annulus of the upper pipe by a surface winch, while maintaining the link with the measuring and/or servicing assembly; electrically conducting the measuring and/or servicing assembly by making the cable head cooperate with a stop ring of the bracket body; and carrying out measurings and/or servicings.

The method of the present invention may also comprise the steps of hanging or suspending the cable head onto a fishing tool lowered into the upper pipe, and removing or introducing into the pipe the cable, the cable head and equipment integral with the cable by the fishing tool.

BRIEF DESCRIPTION OF THE DRAWINGS

Other features and advantages of the present invention will become more apparent from the following description when taken in connection with the accompanying drawings which show non-limitative examples of the present invention, wherein.

DESCRIPTION OF PREFERRED EMBODIMENTS

Figure 1:
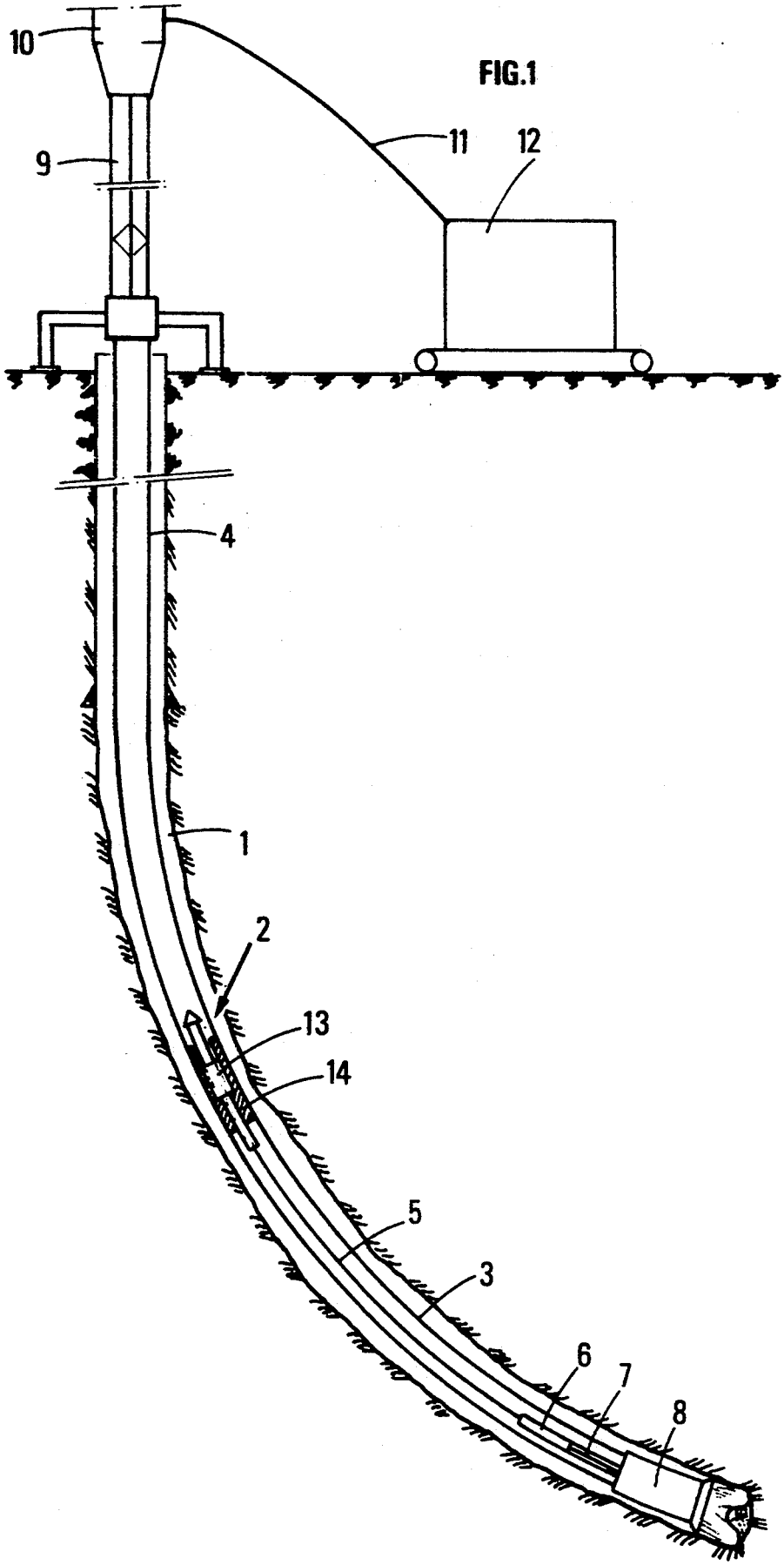
FIG. 1 is a schematic view of the measuring system and the cable bracket associated therein constructed in accordance with the present invention.
Figure 2:
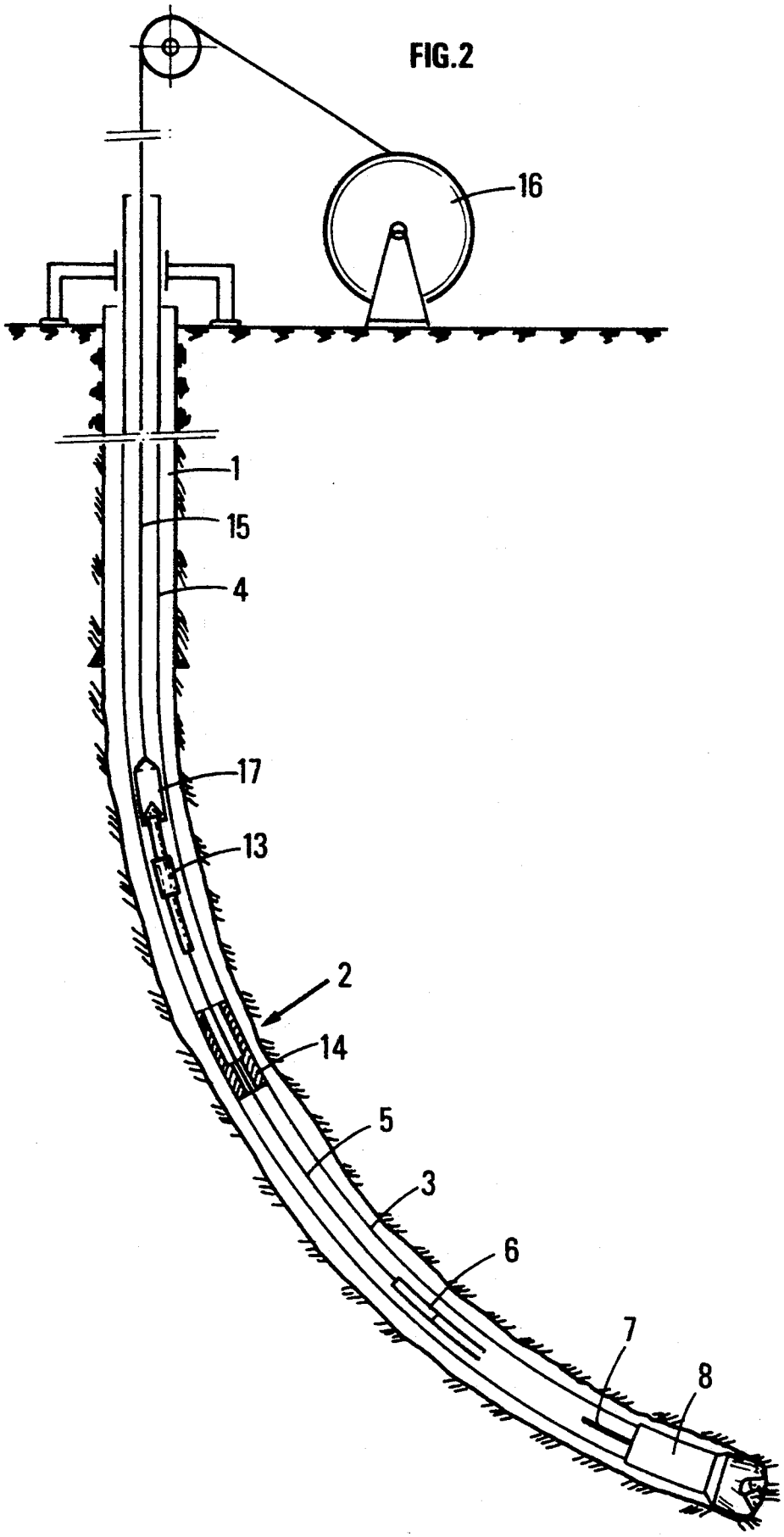
FIG. 2 is a schematic view of a displacement, in a pipe, of the measuring assembly, of the cable and of the head thereof.

FIG. 1 schematically illustrates a well bore into which a pipe including two tubular pipe sections 3, 4 is lowered. The two pipe sections 3, 4, are separated by a bracket 2 of a cable 5. The cable 5 is internal to the inner space of the lower part 3 of the pipe. The respective ends of the cable are connected to a head 13 and to a device 6 which may, for example, include, measuring instruments, a connector 7 linking the electric conductors of the cable 5 to measuring or servicing instruments located in the cabled pipe element 8 at the lower end of the pipe 3, or a combination of instruments integral with the cable, of instruments integral with the cabled pipe element 8 and connected to the cable through a connector.

The upper section 4 of the pipe consists of a string of cabled pipe elements, that is comprising at least one electric conductor and two end connectors. This type of elements is described in, for example, FR-2,607,975, FR-2,607,958 and FR-2,656,747.

The head 13 of cable 5 rests inside the body 14 of bracket 2, supporting thereby the weight of the cable, with the head 13 comprising at least one contact connected to the conductor of the cable. This contact co-operates electrically with a connection means integral with body 14.

In the embodiment of FIG. 1, the connection means of the body 14 of the bracket 2 co-operates electrically with the electric connector of the cabled pipe element next above the bracket 2.

Thus, the device 6 is connected electrically, through the cabled pipe elements, to the kelly 9 located at a surface.

The kelly 9, which is also cabled, is topped by the swivel 10 comprising a rotating electric coupling. The electric link to the surface equipments 12 is achieved by a cable 11.

When the pipe has the configuration shown in FIG.1, the whole of the tubular string may be rotated, notably for drilling, while having a continuous electric link from the surface to the bottomhole device 6 or to the equipments located in stem 8. Drilling progresses conventionally by adding cabled stems at the surface.

This embodiment is particularly advantageous when the device comprises measuring instruments allowing the surrounding environment to be known better and/or drilling to be pilot controlled.

In fact, it is sometimes necessary to perform a servicing operation on measuring device 6, or to remove this device temporarily to clear the total inner channel of the string. To that effect, a winch 16 of the "wire line" type, which is conventionally used in the profession, is utilized, the wire 15 being provided at its lower end with a fishing tool 17. After dismounting the kelly, the bell 17 is maneuvered in the inner space of line 4. When the head 13 is fastened, the device 6 suspended from the end of cable 5 and wire 15 may be taken up to the surface. As a matter of fact, the body 14 of bracket 2 is adapted to allow passage of assembly 6.

If required by operations, it will be possible to take down device 6, with the same type of equipment as that used for the outgoing maneuver, and to electrically connect the device 6 installed at the bottom of the well, by the electric co-operation of the head 13 with the connection means integral with body 14.

Lowering the device 6 may be achieved by gravity, but also by pumping if the well is strongly inclined. Device 6, at the end of cable 5, must then be provided with a traction element or "locomotive", propelled by the pumping inside the pipe. A preventer forming a seal around wire 15 then has to be mounted on the upper end of the pipe. These operating procedures are well-known in the prior art. The traction element or "locomotive" is adapted to pass through the body 14 of bracket 2.

Figure 3:
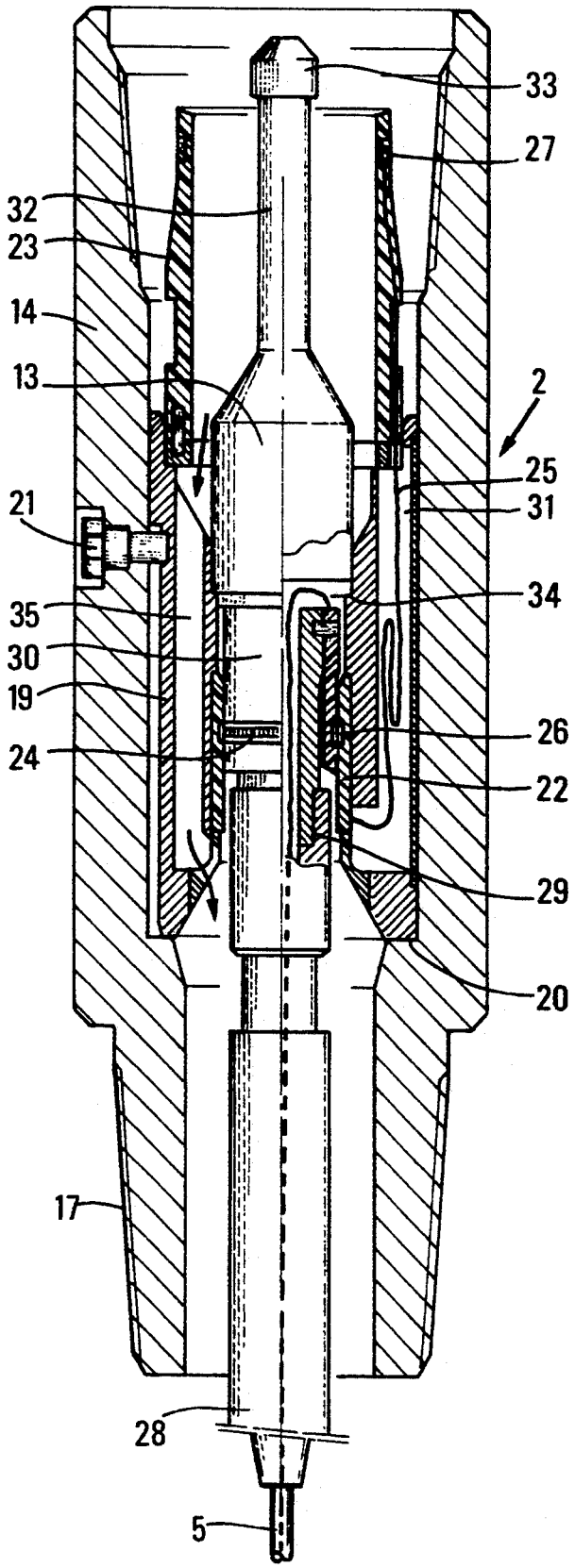
FIG. 3 is a cross-sectional view of a preferred embodiment of a bracket of the present invention.

FIG.3 shows the preferred embodiment of the cable bracket according to the invention. This bracket 2 mainly consists of a body 14 and a cable head 13.

The body 14 comprises at each end joining means in the form of threads. The lower thread 17 is adapted to connect onto the upper tube of pipe 3. The upper thread 18 is adapted to connect onto the lower tube of pipe 4, preferably composed of cabled pipe elements.

An annular part 19 is immovably fastened to the body by a stop ring 20 and of lateral screws 21. This part 19 bears the electric connection means which is then integral with body 14. This means comprises two elements 22 and 23. One element 22 co-operates electrically with the contact 24 borne by the cable head, and the other element 23 is adapted to co-operate with the lower connector of a cabled pipe element. These two elements 22,23 are linked together by at least one conducting wire 25 connecting electrically to one another the contacts 26 and 27 borne by the elements 22 and 23 of the connection means integral with the body of the bracket.

The cable head 13 includes of two main parts. The lower part 28 is adapted to mechanically fasten the cable 5 by way of the usual means used in the profession. This part is screwed through thread 29 on the specific upper pare 30. The upper part 30 abuts axially against the shoulder 34 of the annular part 19. The cable head supports the cable and the axial force corresponding to the weight suspended under the head is general sufficient to keep the cable head resting on this stop ring 34.

Without departing from the scope of this invention, the head may be locked mechanically when it is in a position of rest.

The contact 24 connected to the cable conductor is generally annular. Pipe 31 allows passage of conductor or conductors 25.

The upper part of element 30 comprises a pin 32 and a fastening head 33 adapted to the screw bell 17 used.

One or several channels 35 arranged in the annular part 19 to allow the drilling fluid to pass around head 13 to reach the end of the string.

Figure 4:
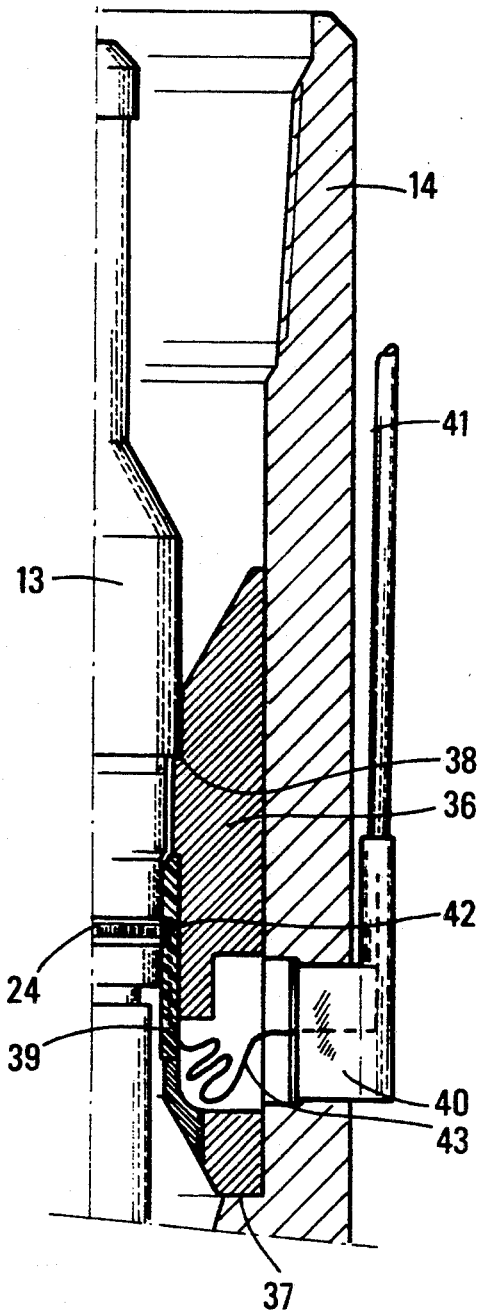
FIG. 4 is a cross-sectional view of another embodiment of a bracket constructed in accordance with the present invention.

FIG.4 shows a variant in which the cable head 13 is substantially identical to that in the previous embodiment. The body 14 of the bracket has the same fastening means on the lower and upper parts of the tubular string. An annular part 36 bears the electric connection means consisting of element 39 and plug 40. The element 39 co-operates electrically with the contact 24 of head 13, by means of the contact 42 connected to plug 40 through conducting wire 43.

The annular part 36 is integral with the body 14 of the bracket through stop ring 37 and through lateral screws similar to the screws 21 of FIG.3, but not shown in FIG.4.

Plug 40 is connected to cable 41 comprising at least one electric conductor.

Through the co-operation of head 13 with the stop ring 38 of annular part 36, the conductor of cable 5 is connected to the surface through the electric continuity provided by contact 24, contact 42, cable 43, plug 40 and cable 41 located outside the bracket according to the invention.

The various embodiments have been described with a single electric connection but, without departing from the scope of the present invention, electric connections with several electric lines may be achieved.

I claim:

1. A bracket for a cable adapted to be inserted into a tubular pipe, and divide the tubular pipe into a lower part and an upper part, said cable being disposed internally in said lower part, said tubular pipe comprising at least one electric conductor, wherein:

said bracket comprises a body assembled between said upper and lower parts and a cable head to which one end of said cable is fastened, said body comprises a stop ring limiting, in one direction, the displacement of said cable head, said cable head comprises at least one electric contact connected to said at least one electric conductor, and wherein said at least one contact electrically co-operates with a connection means when said cable head cooperates with said stop ring, said connection means being integral with said body.

2. A bracket as claimed in claim 1, wherein said cable comprises at least one device immovably fastened to on an end of said cable opposite to said cable head, and wherein said body is adapted to allow inner passage of said device.

3. A bracket as claimed in one of claims 1 or 2, wherein said connection means is adapted to electrically connect said at least one contact of head to a continuous electric link along the upper part of the tubular cable.

4. A bracket as claimed in one of claims 1 or 2, wherein said connection means electrically connects said contact of the cable head to an end of a cable located outside of said body.

5. A bracket as claimed in claim 2, wherein said device includes at least one of a measuring and/or servicing assembly or a connector adapted to connect onto the measuring and/or servicing assembly.

6. A bracket as claimed in one of claims 1 or 2, wherein said head comprises a fishing device adapted to be suspended on a tool lowered into the upper part of the pipe.

7. A system for carrying out measurements and/or servicing in a well, the system comprising:

an electric transmission cable adapted to be disposed internally in a lower part of a tubular pipe, and comprising at least one of a measuring and/or servicing assembly or a connector connecting said cable to a measuring and/or servicing assembly integral with the end of the pipe fastened to a lower end of said cable, a cable bracket as claimed in one of claims 1 or 2, a continuous electric link between said bracket and a surface of the well, said continuous electric link being fashioned as one of cabled pipe elements forming an upper part of the tubular pipe or a cable located outside said tubular pipe.

8. A method for carrying out measurements and/or servicing by the system as claimed in claim 7, the method comprising the steps of:

displacing the measuring and/or servicing assembly by one of lengthening or shortening said tubular pipe through one of cabled pipe elements or a cable located outside the tubular pipe, and controlling the length of the cable located in an annulus of the upper part of the tubular pipe by a surface winch while maintaining the continuous electric link with the measuring and/or servicing assembly, electrically connecting the measuring and/or servicing assembly by making said cable head co-operate with the stop ring of said body of the bracket, and carrying out the measurements and/or servicing.

9. A method as claimed in claim 8, further comprising the steps of:

suspending the cable head on a fishing tool lowered into the upper part of the tubular pipe, and removing or introducing into the tubular pipe, the cable, the cable head and the device integral with the cable, by the fishing tool.

* * * * *